US005201002A

United States Patent [19]

Dahlem

[11] Patent Number: 5,201,002

[45] Date of Patent: Apr. 6, 1993

[54] STEREO SOUND PILLOW AND METHOD OF MAKING

[76] Inventor: Robert L. Dahlem, 204 Hackberry, Streamwood, Ill. 60107

[21] Appl. No.: 560,108

[22] Filed: Jul. 31, 1990

[51] Int. Cl.[5] ..... H04R 5/02

[52] U.S. Cl. ..... 381/24; 381/188; 381/205; 381/90; 381/182

[58] Field of Search ..... 381/24, 188, 205, 90, 381/182; 5/434, 436, 442

[56] References Cited

U.S. PATENT DOCUMENTS

| | | | |
|---|---|---|---|
| 3,234,569 | 2/1966 | Stewart | 5/434 |
| 3,290,704 | 12/1966 | Willis | 5/434 |
| 3,858,257 | 1/1975 | Young | 5/434 |
| 4,782,533 | 11/1988 | Haynie | 381/24 |
| 4,862,438 | 8/1987 | Fry | 381/24 |

*Primary Examiner*—Jin F. Ng
*Assistant Examiner*—Sylvia Chen
*Attorney, Agent, or Firm*—Charles F. Lind

[57] ABSTRACT

The disclosed stereo sound pillow has a resilient interior fibrous composite and an essentially nonextendable exterior case completely enclosing the interior composite. Sound speakers having sound outlets from both front and rear sides thereof, and lead wires connected to each speaker, are fixed to a flexible mounting strip: and the mounting strip and speakers are surrounded by the interior composite to hold the sound speakers suspended within the interior composite, spaced apart lengthwise and from the side and end edges thereof, and the lead wires exit from the exterior case adjacent one end edge. The mounting strip allows the fast and economical fabrication of the pillow, either: as the interior composite is formed by rolling up a web of the fibrous material on itself and over the mounting strip and speakers, or after the interior composite is fitted inside of the exterior case by parting the interior composite and inserting the mounting strip and speakers into the defined cavity in the composite interior and then collapsing the cavity. The mounting strip may be made from the same material used for the resilient interior fibrous composite.

13 Claims, 2 Drawing Sheets

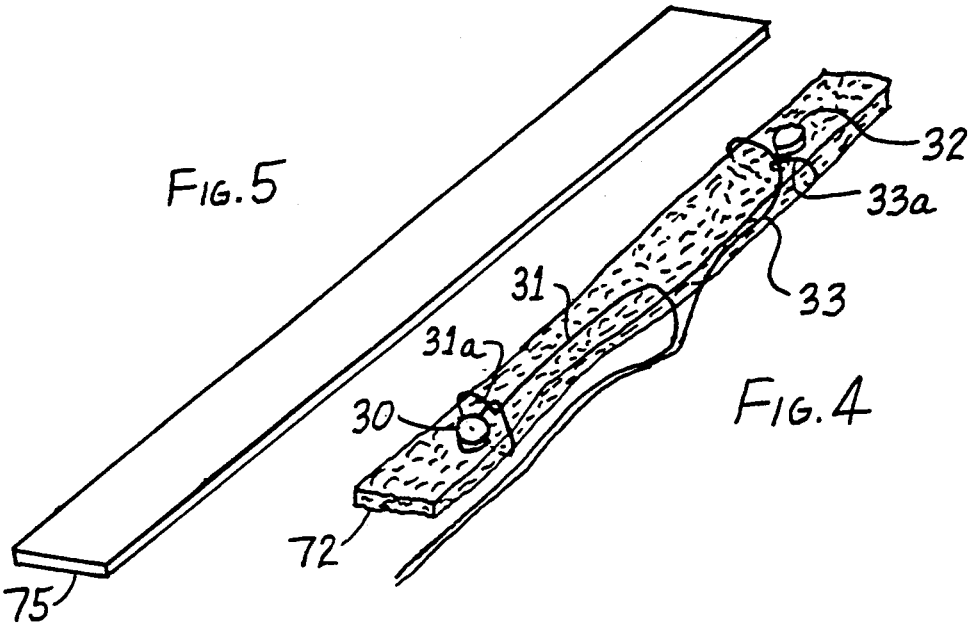
FIG. 5
FIG. 4
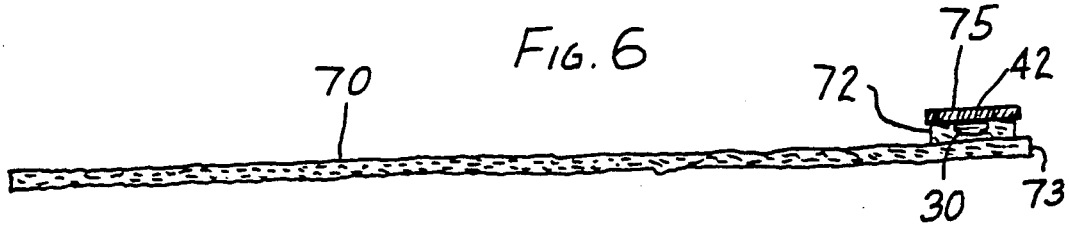
FIG. 6
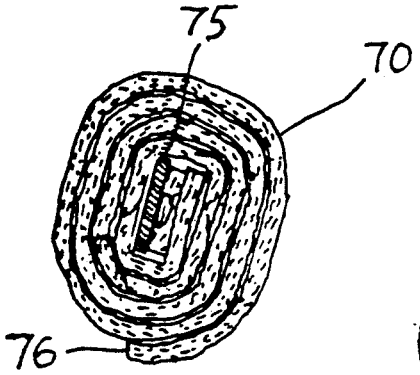
FIG. 9
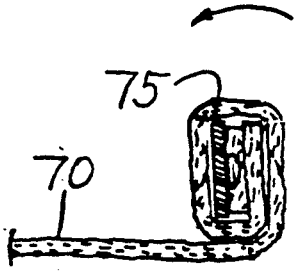
FIG. 8
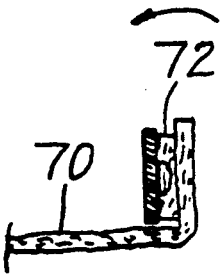
FIG. 7

STEREO SOUND PILLOW AND METHOD OF MAKING

BACKGROUND OF THE INVENTION

A typical pillow is shaped as a substantially symmetrical rounded rectangular block or blob, with opposing top and bottom faces and interconnecting sides. Several universally desirable characteristics of a pillow have been its ability to be "fluffed up" and to be flipped over 180 degrees to expose the top or bottom face as desired.

Pillows have been disclosed with sound speakers located therein: in Halstead U.S. Pat. No. 2,512,641; in Majoros U.S. Pat. No. 3,290,450; in Pruitt U.S. Pat. No. 3,621,155; in Yeaple U.S. Pat. No. 4,038,499; and in Haynie U.S. Pat. No. 4,782,533. Moreover, Neal U.S. Pat. No. 1,712,158, Bounds U.S. Pat. No. 2,958,769, and Fry U.S. Pat. No. 4,862,533 each have both the sound speakers and the audio source held in the pillow structure.

Design factors have reduced the commercial attractiveness of these patented structures. For example, specialized components have been used for holding the speakers in place in the pillow, increasing the overall pillow cost because of added costs of such specialized components and the fabricating dies, molds or the like for making them. Specialized components also tend to complicate the inventory situation in making the sound pillows, particularly when making pillows of different sizes, such as the conventional Standard, Queen or King sizes.

Moreover, the type and orientation of the speakers may make the sound pillow usable only in a unidirectional manner, meaning that the pillow top can only be used as the pillow top, against which the user's head rests. Also, the pillow structures may be incapable of being fluffed up or contoured as desired, as the resilient pillow mass may be formed of a foam rubber material or the speaker holding means may be formed of a nonflexible framing material.

Lastly, the ease for fabricating the sound pillow and/or assembly time is critical, for holding the overall pillow cost down, even if and/or where specialized component means are needed and must be handled individually as separate fabricating steps.

My copending application for patent filed on Feb. 2, 1990 and having Ser. No. 07/473,867 and entitled STEREO SOUND PILLOW AND METHOD OF MAKING, now abandoned, disclosed an improved stereo sound pillow that corrected many of these mentioned drawbacks. The disclosed pillow had a resilient composite fiberous material formed of a vast plurality of separate strands, each strand being greatly elongated compared to its cross-section and randomly disposed and loosely packed relative to and against one another, and had a case surrounding this material and generally defining the overall pillow shape. Sound speakers were held suspended within the resilient material in spaced apart locations, by the interlocked cooperation of the speakers and their lead wires solely with the composite material. The disclosed method of locating and securing the speakers in place in the composite material included parting the material from one side edge along a central cavity, separating a band of separate strands adjacent the cavity, and looping each speaker and its lead wire around the band and through itself, to isolate that speaker relative to the band and loop.

While my invention provided an economical stereo sound pillow, one superior or comparable to the listed prior patents, it did require some individual assembly for increased fabrication costs.

SUMMARY OF THE INVENTION

This invention relates to a stereo sound pillow having sound speakers held therewithin such that the pillow structure can be fluffed up or shaped as desired without disrupting the positions of the speakers.

The basic objects of this invention are to provide improved constructions for and methods of making such a stereo sound pillow, that allow for the easy and economical fabrication in an assembly line manner, while yet using no specialized high costs components for holding the speakers inside of the pillow or the like.

BRIEF DESCRIPTION OF THE DRAWINGS

Further objects, advantages and features of the present invention will appear from the following disclosure and description, including as a part thereof the accompanying drawings, in which:

FIG. 4 is a perspective view of a mounting component or strip used for holding the speakers within the sound pillow of FIG. 1, and shown with the speakers tied in place thereto in an intermediate stage of fabrication;

FIG. 5 is a perspective view of a tool to be used for holding the speakers and mounting component of FIG. 4, in place while fabricating the sound pillow of FIG. 1 according to one embodiment of the invention;

FIGS. 6, 7, 8 and 9 are side elevational views of a web of the resilient composite material used to form the pillow, shown in FIG. 6 in an initial stage of fabrication with the mounting component and speakers held thereby of FIG. 4 and tool of FIG. 5, and shown also in FIGS. 7, 8 and 9 in three intermediate stages of fabrication of the pillow:

DETAILED DESCRIPTION OF THE ILLUSTRATED EMBODIMENTS

Figure 1:
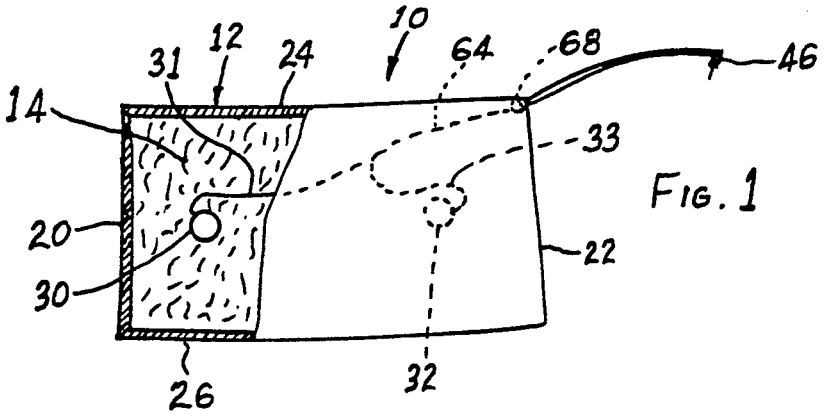
FIG. 1 is a top plan view of a sound pillow to be disclosed herein, having part of it cut away for the sake of clarity to show how one speaker is suspended in place in the pillow.
Figure 2:
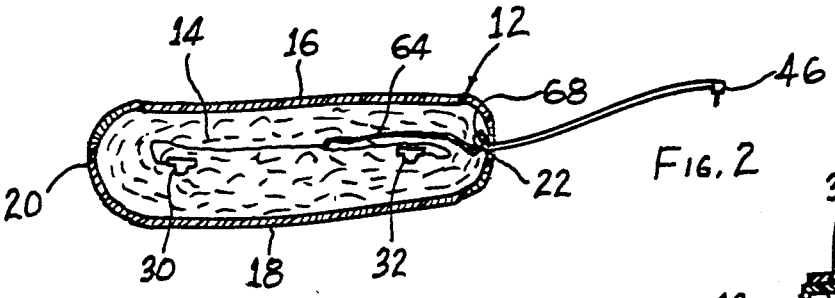
FIG. 2 is a frontal sectional view of the sound pillow of FIG. 1.

FIG. 1 shows a sound pillow 10 having an exterior case 12 and an interior resilient composite 14. The case 12 is conventional, having opposing top and bottom sheets 16 and 18, each being flexible but essentially nonextendable and joined together or common with one another along opposite end edge seams 20 and 22, and opposed side edge seams 24 and 26. The case 12 thus effectively completely encloses the interior composite 14 and defines the maximum length, width and thickness dimensions of the interior composite.

The interior composite 14 is formed of a fiberous material having a vast plurality of separate strands, each strand being greatly elongated compared to its cross-section and randomly disposed relative to and loosely packed against one another. A synthetic siliconized polyester fiber might be used in the form of a flexible filler. Thus, the raw fibers, possibly fifteen denir by two inches long, might be subjected to garnetting to separate and randomly intermix them; which then would be reoriented by bunching into a web 70 (see FIGS. 6–9 for example). The fiberous material web can then be spirally wound to yield a sufficient quantity or mass build up to substantially fill the interior of the case, to the desired density.

Sound speakers 30 and 32 having lead wires 31 and 33 are provided. According to the best mode of the invention, each speaker has an annular frame 36 and an electrically driven cone diaphragm 38 suspended across the annular frame 36; and the speaker frame 36 is contained in a housing 39 having a protective rear frame 40 with circumferentially spaced openings 41 therein and having a removable cover 42 with spaced perforations 43 therein. The housing 39 thus is extended across both the front and rear sides of the cone diaphragm 38, and the openings 41 and 43 adjacent thereto, acts in the manner of grillwork to structurally enclose but yet provide sound outlets from both the front and rear sides of the speaker.

The sound speakers 30 and 32 are suspended by the interior composite 14 inside the case 12, each being spaced apart lengthwise and from the end edges 20 and 22 and generally centered between the side edges 24 and 26. In an average size pillow, the speaker-to-end edge spacing may be between approximately three and five inches. The individual lead wires 31 and 33 for the speakers 30 and 32 exit from the corner of the case 12 through edge seam 22; typically with the separate lead wires 31 and 33 being united or combined together as a single common lead when outside of the pillow. A conventional mini (3.5 mm) male stereo jack 46 is connected to the lead wires 31 and 33, suited for being inserted into the conventional female headphone jack (not shown) on portable stereo radios or like audio equipment, or an ¼" adapter (not shown), operable to connect the sound output of the equipment to the pillow speakers 30 and 32.

Each speaker 30 and 32 is held suspended by the interior composite 14 spaced from and within the case 12. This cooperative mounting is established during the initial fabrication of the sound pillow, including as the webbing of the interior composite is being spirally wound or after the interior composite has been formed and inserted into the exterior case but before the edge seam 22 has been sewn closed so that the interior composite 14 is yet exposed. A low costs mounting component or strip 72 (see FIG. 4) is used for locating and holding the speakers inside of the pillow, for easily and economically making the stereo sound pillow in an assembly line manner.

To use the mounting strip 72, each sound speaker 30 and 32 of the stereo pair generally would first be fixed relative to the mounting strip 72, such as illustrated, by wrapping each lead wire 31 and 33 around the mounting strip and passing the speaker through the defined loop 31*a* and 33*a* to loosely knot each speaker onto the strip. The mounting strip 72 may be about the same length as or just slightly shorter than the width of the web 70 to be used in the pillow, so that the center and end spacings of the sound speakers 30 and 32 along the strip 72 would be roughly the same as desired and above noted when positioned inside of the pillow. The lead wires 31 and 33 would both exit from the mounting strip 72 off of only one end.

This preassembly of the speakers 30 and 32 onto the mounting strip 72 can be easily done at a work station separated from the garnetting machine and/or web 70; where many like assemblies can be made for making many pillows. Each mounting strip 72 can be of resilient fiberous composite webbing material, preferably even of the same material as the webbing 70 used to form the pillow itself. Each mounting strip 72 would be precut to a suitable width, approximately 3–6 inches wide, and as noted may be about the same length as or just slightly shorter than the width of the web 70 used in the pillow. The durability of the mounting strip 72 can be increased by lightly spraying it with an adhesive prior to the speaker-strip assembly steps already mentioned, and to other assembly steps to be mentioned now.

One mode of using the mounting strip 72 and the speakers 30 and 32 held thereon is to incorporate them into the pillow inside 14 as it is being spirally wound and formed. Thus, after the garnetted web 70 is cut to length to correspond to the needed weight of the intended pillow inside and is laid out flat on a conveyor apron or the like, the mounting strip 72 with the speakers fixed thereon, can be positioned on the web adjacent one lead end 73 (see FIG. 6). A flat narrow tool 75 would preferably be used, with one of its flat faces pressed against the relatively flat protective fronts 42 of the speakers 30 and 32, for holding the speakers directionally parallel to the tool face. With the tool 75 so positioned against the speakers and mounting strip 72, the web 70 can then be spirally wound, with the underlying lead end 73 being folded up and over and around the tool and mounting strip, even carrying them and flipping them over (one-quarter of a turn in FIG. 7 and three-quarters of a turn in FIG. 8). This flipping over movement may be continued until the entire length of webbing has been wound around the tool 75, the mounting strip 72, and the speakers 30 and 32 (see FIG. 9).

One manner of so flipping the web 70 over may be manual. Another manner of so flipping the web 70 over may include a conveyor (not shown) that underlies and supports the web 70 and moves it and the tool, mounting strip, and speakers thereon to the right in FIG. 6, while a second conveyor (not shown) moves upwardly at approximately right angles from the moving web on the first conveyor, to lift the engaging lead end of the web. Manual manipulation may be needed to hold the tool 75 against the speakers as the lead end is initially folded from the flat in the start position (FIG. 6) to the successive intermediate positions of FIGS. 7 and 8; but afterwards, when the tool is contained within the encircling webbing, the continued flipping over of the webbing can proceed with little manual intervention.

The tool 75 illustrated would be of a structurally rigid, smooth and lightweight material, such as wood or plastic, to allow this flipping movement to take place without undue effort. The tool would be longer than the width of the webbing 70, to project beyond one side edge of the webbing as it is being wound and to be exposed even after the webbing has been completely wound. The tool would also be void of any rough edges to allow it to be moved relative to the fiberous material, as will be noted.

FIG. 9 illustrates the webbing 70 as it may be when fully wound, with the tool 75 being exposed and at some arbitrary angle relative to the trailing end 76 of the webbing. Normally, the spirally wound resilient mass is slightly out of round, but generally cylindrical; but the bulges or flattened spots typically have no relationship to the orientations of the speakers. However, as the angle of the tool can readily be seen, the entire resilient mass with the tool therein can be rotated until the tool face held against the speakers is set horizontal; whereupon the resilient mass can be inserted into the open end of the exterior casing 12, with the top and bottom faces 16 and 18 of the pillow now also being horizontal. The tool 75 can then be withdrawn from the fiberous material and the open seam sewn closed, with the speaker lead wires exiting from the pillow as noted above.

It will be appreciated that the resilient pillow inside 14 and the mounting strip 72, each being of fiberous composite materials having the vast plurality of separate randomly disposed and loosely packed strands, will become intertwined once they contact and/or have relative to one another. This means that the speakers also become relatively fixed in the pillow, spacing-wise and orientation-wise, and will remain within and relative to the adjacent resilient webbing and mounting strip in just about the same orientation after the tool removal as before. With the speakers so suspended within and by the composite material, the pillow can be fluffed up or beaten flat or used in a normal expected manner, without having the relative position of the speakers shifted.

Figure 3:
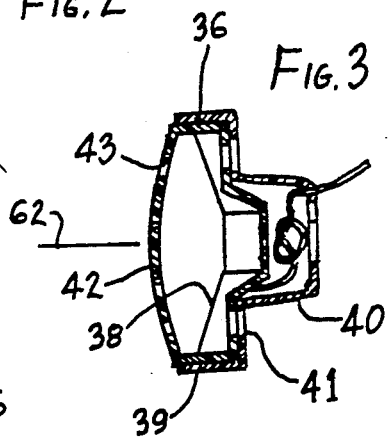
FIG. 3 is an enlarged fragmentary sectional view of a typical speaker used in the sound pillow of FIG. 1.

Each speaker 30 and 32 may be ideally positioned to direct its concentric center axis 62 (see FIG. 3) approximately perpendicular to the top and bottom sheets or faces 16 and 18 of the pillow; although that orientation has been found not to be critical. Thus, the sound diverges over a wide angle from the cone diaphragm 38, both forwardly and rearwardly thereof, to allow substantial tilting of the speaker from this perpendicular ideal, even up to a 45 degree tilt. This construction allows the sound pillow 10 to be flipped over 180 degrees, reversing the pillow sheets or faces 16 and 18 from that shown.

Figure 11:
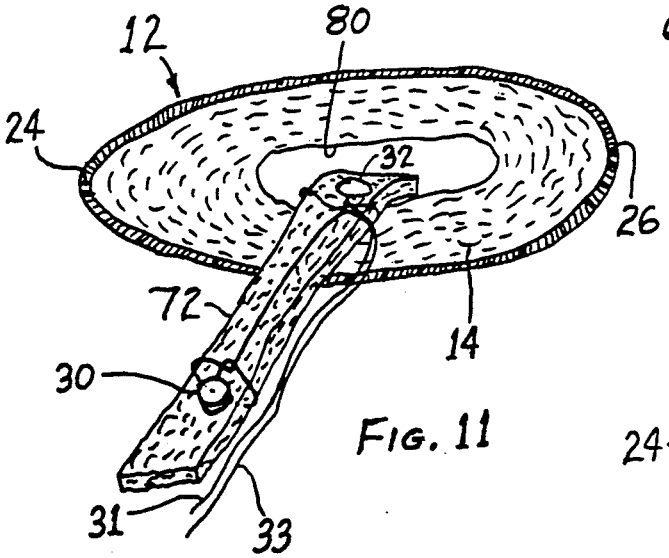
FIG. 11 is an endward perspective view of an appropriately flattened out mass of the composite pillow material contained in an outer case, except illustrating it in an intermediate stage of fabrication according to an alternative embodiment of the invention, where the material has been centrally parted from one end edge to define an interior cavity, and illustrating the FIG. 4 mounting component and speakers held thereby being inserted into the cavity, to form the sound pillow of FIG. 1.
Figure 10:
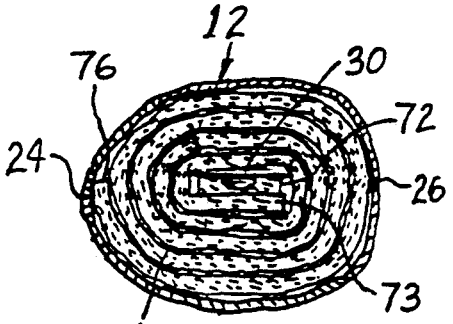
FIG. 10 is an end sectional view of the spirally wound composite material web and one located sound speaker held therein, being somewhat appropriately flattened out and contained within the outer case, to form the sound pillow of FIG. 1.

An alternative mode of using the mounting strip 72 and the speakers 30 and 32 held thereon would be after the resilient pillow inside 14 had been spirally formed and inserted into an exterior casing 12, while yet having one end edge casing seam open. The resilient composite material 14 would first be parted from the open end, to define a substantially centered cavity 80 extended lengthwise into the composite to the debth desired. Parting the fiberous composite material is relatively easy to do. The mounting strip 72 and the speakers 30 and 32 held thereon would then be inserted into the cavity 80 (see FIG. 11) to the desired speaker location within the resilient pillow. The tool 75 may be used if desired, being initially inserted into the cavity to allow the mounting strip 72 and the speakers 30 and 32 held thereon to slide freely along the length of the tool to the desired location. Upon removal of the tool, the casing end seam may be sewn closed.

As noted above, the fiberous mounting strip becomes laterally fixed relative to the fiberous pillow composite 14, once the cavity is collapsed to intertwine the opposite cavity faces against one another. The speakers also will become relatively fixed in the pillow, spacing-wise and orientation-wise, and will remain so oriented later even when the pillow is fluffed up or beaten flat as might be expected during normal use.

Prior to sewing the exterior pillow casing 12 closed, the combined lead wire 64 of the separate lead wires 31 and 33 may be looped or knotted as at 68, to fit against the edge seam 22 on the inside of the case when the edge seam is sewn closed. This limits withdrawal of the lead wires from the case 12, so as to minimize shifting of the speakers 30 and 32 within the interior composite 14 that might otherwise be caused by pulling on the lead wire from outside of the case.

While specific embodiments of the invention have been illustrated, it is apparent that variations may be made therefrom without departing from the inventive concept. Thus, alternative means for securing each sound speaker relative to the mounting strip might include merely separating the fibers to form an opening in the strip through which the speaker might be inserted or by stapling or otherwise securing the lead line to the strip proximate the speaker. Accordingly, the invention is to be limited only by the scope of the following claims.

What is claimed as my inventions is:

1. A stereo sound pillow, comprising the combination of a pillow structure having an exterior case and an interior resilient composite;

said case having opposing top and bottom flexible but essentially nonextendable sheets joined together along edge seams, effective for having the case completely enclose the interior composite and define the maximum length, width and thickness dimensions of the interior composite; and said interior composite being of a fiberous material having a vast plurality of separate strands, each strand being greatly elongated compared to its cross-section and randomly disposed relative to and loosely packed against one another, effective to build up to a resilient mass of a size substantially filling the interior of the case;

audio sound speakers each having an annular frame and an electrically driven cone diaphragm suspended across the frame, and each having a housing holding the annular speaker frame and having open but protective grillwork extended across both the front and rear sides of the cone diaphragm, providing sound outlets from both sides of the speaker;

a narrow strip of a flexible material and means for holding the sound speakers relative to the strip at specific spaced locations therealong;

said strip being surrounded by and held suspended within the interior composite for supporting said speakers inside of the pillow structure at locations spaced apart lengthwise and from the end edges thereof and generally centered between the side edges thereof; and lead wires connected to each speaker and exiting from the case through one edge seam.

2. A stereo sound pillow according to claim 1, wherein the means for holding each sound speaker relative to the strip includes having said lead wire for each speaker wrapped around the strip in the form of a loop and then inserted through the loop itself, to have the speaker knotted relative to the strip.

3. A stereo sound pillow according to claim 1, wherein said strip is formed of the same fiberous material as said interior resilient composite.

4. A stereo sound pillow according to claim 1, wherein said strip has a width of the order of 3–6 inches and a length about the same as or just shorted than the length of the pillow, and is extended generally centered lengthwise of the pillow.

5. A stereo sound pillow according to claim 1, wherein said strip is formed of the same fiberous material as said interior resilient composite and has a width of the order of 3–6 inches and a length about the same as or just shorted than the length of the pillow, and wherein the means for holding each sound speaker relative to the strip includes having said lead wire for each speaker wrapped around the strip in the form of a loop and then inserted through the loop itself, to have the speaker knotted relative to the strip.

6. A stereo sound pillow according to claim 1, wherein the sound pillow is formed by steps including having said interior fiberous material composite in the form of a generally flat web of a width similar to the length generally of the intended pillow and of a length sufficient to provide the intended pillow weight, positioning the strip with the speakers held thereto on the web adjacent one end thereof and holding the speakers in predetermined specific orientations by means visible beyond the web, rolling the web around the strip and speakers held thereto and itself to define a web mass having all of the web rolled thereon, orienting the speakers to generally known orientations by observing the visible means extended beyond the web by rotating the entire web mass and then inserting the web mass open end of the exterior case with the speakers generally facing the top and bottom faces of the pillow, and closing the one edge seam of the exterior case.

7. A stereo sound pillow made according to claim 6, wherein the steps of forming the sound pillow further includes using a tool positioned against the speakers and exposed beyond the web as the visible means for holding the speakers in the predetermined specific orientations as the web is rolled around both the tool and the strip to form the web mass, and then removing the tool from proximity of the speakers and from the web mass after the web mass has been formed.

8. A stereo sound pillow made according to claim 6, wherein the steps of forming the sound pillow further includes having said strip formed of the same fiberous material as said interior resilient composite, and knotting the lead wire for each speaker around the strip as the means for holding each sound speaker relative to the strip.

9. A stereo sound pillow according to claim 1, wherein the sound pillow is formed by steps including forming the interior resilient composite and inserting it into the exterior case at one open end via one open edge seam thereof, parting many adjacent strands of the interior resilient composite from one another to define a substantially centered cavity extended lengthwise of and in the interior composite open to the one open end of the exterior case, inserting the strip and the speakers held thereto via the open end of the exterior case into the cavity and having the speakers generally facing the top and bottom faces of the pillow and at the appropriate locations thereof relative to the pillow and with the wire leads extended to the one open edge seam, collapsing the cavity and adjacent strands thereof around and against the strip, sound speakers and lead wires and one another, and closing the one edge seam of the exterior case.

10. A stereo sound pillow made according to claim 9, wherein the steps of forming the sound pillow further includes using a tool positioned against the interior composite at the cavity and extended therefrom to beyond the one open case end, and inserting the strip and the speakers fixed thereto into the cavity by sliding them along the tool until at the appropriate relative positions, removing the tool from the cavity, and closing the one edge seam of the exterior case.

11. A stereo sound pillow made according to claim 9, wherein the steps of forming the sound pillow further includes forming said strip of the same fiberous material as said interior resilient composite, and knotting each lead wire around the strip to locate and hold the sound speaker relative to the strip.

12. A method of making a stereo sound pillow, comprising the steps of laying out a web of a fiberous material composite having a width similar to the length generally of the intended pillow and of a thickness and length sufficient to provide the intended pillow weight, positioning a strip with speakers fixed thereto on the web adjacent one end thereof and holding the speakers in predetermined specific orientations and having means visible beyond the web indicating this orientation, rolling the web around the strip and speakers fixed thereto and itself to define a web mass having all of the web rolled thereon, orienting the speakers to generally known orientations by observing the visible means extended beyond the web by rotating the entire web mass and then inserting the web mass into an open end of an exterior case with the speakers generally facing the top and bottom faces of the pillow, and closing the open end of the exterior case.

13. A method of making a stereo sound pillow, comprising the steps of filling a flexible but essentially nonextendable exterior case with an interior resilient fiberous composite material having a vast plurality of separate strands each being greatly elongated compared to its cross-section and randomly disposed relative to and loosely packed against one another; parting the interior resilient composite to define a substantially centered cavity extended lengthwise of and in the interior composite open to one open end of the exterior case; fixing sound speakers having sound outlets from both front and rear sides thereof to an elongated narrow mounting strip at spaced apart lengthwise positions and having lead wires from the speakers extended along the mounting strip to one end thereof; inserting the opposite end of the mounting strip with the speakers fixed thereon into the cavity and generally centered within the case and having the lead wire exit from the case through one open end thereof; collapsing the cavity to reposition the interior resilient composite around and against the mounting strip, sound speakers and lead wires and one another; and closing the one open end of the case with the lead wires exiting therefrom.

* * * * *